US012649998B2

(12) United States Patent
Arntz

(10) Patent No.: US 12,649,998 B2
(45) Date of Patent: Jun. 9, 2026

(54) DETACHABLE FLUIDISATION DEVICE

(71) Applicant: GBM WORKS IP B.V., Amsterdam (NL)

(72) Inventor: Bernardus Johannes Maria Arntz, Utrecht (NL)

(73) Assignee: GBM WORKS IP B.V., Amsterdam (NL)

( * ) Notice: Subject to any disclaimer, the term of this patent is extended or adjusted under 35 U.S.C. 154(b) by 91 days.

(21) Appl. No.: 18/700,856

(22) PCT Filed: Oct. 12, 2022

(86) PCT No.: PCT/EP2022/078357
§ 371 (c)(1),
(2) Date: Apr. 12, 2024

(87) PCT Pub. No.: WO2023/062061
PCT Pub. Date: Apr. 20, 2023

(65) Prior Publication Data

US 2024/0426072 A1 Dec. 26, 2024

(30) Foreign Application Priority Data

Oct. 13, 2021 (NL) ..... 2029399

(51) Int. Cl.
*E02D 7/28* (2006.01)
*E02D 5/32* (2006.01)
(Continued)

(52) U.S. Cl.
CPC ..... *E02D 7/28* (2013.01); *E02D 5/32* (2013.01); *E02D 7/26* (2013.01); *E21B 7/208* (2013.01)

(58) Field of Classification Search
CPC .... E02D 5/32; E02D 7/18; E02D 7/24; E02D 7/26; E02D 7/28; E21B 7/20; E21B 7/208; E21B 7/24
See application file for complete search history.

(56) References Cited

U.S. PATENT DOCUMENTS 3,839,875 A 10/1974 Matsushita
3,965,687 A * 6/1976 Shaw ..... B63B 21/27 405/226

(Continued)

FOREIGN PATENT DOCUMENTS

AT 363044 B 7/1981
EP 1497503 A1 1/2005

(Continued)

OTHER PUBLICATIONS

International Search Report and Written Opinion dated Jan. 12, 2023 in co-pending PCT Application No. PCT/EP2022/078357.

*Primary Examiner* — Kyle Armstrong
(74) *Attorney, Agent, or Firm* — Perilla Knox Hildebrandt Staley & Amy LLP

(57) ABSTRACT

The invention is directed to a detachable fluidisation device for use in a vertical positioned tubular foundation pile having a pile axis and comprising of a central element and radially extending fixing means. The radially extending fixing means can have a first position wherein, in use, the central element is radially fixed to the interior of the tubular foundation pile and a second position which allows the fluidisation device to axially move along the length of the tubular foundation pile. The central element has at its lower end a rotating lower end provided with horizontally extending arms. The arms are each provided with high pressure water injection nozzles and with mechanical cutting elements extending from the arm in the direction of rotation.

17 Claims, 7 Drawing Sheets

(51) Int. Cl.
*E02D 7/26* (2006.01)
*E21B 7/20* (2006.01)

(56) References Cited

U.S. PATENT DOCUMENTS

| | | | | |
|---|---|---|---|---|
| 4,673,312 | A * | 6/1987 | Nussbaumer | E21B 4/18 405/184 |
| 5,653,556 | A | 8/1997 | White | |
| 2012/0076591 | A1* | 3/2012 | Peters | E02D 13/04 405/228 |
| 2014/0064857 | A1 | 3/2014 | Herrmann | |
| 2019/0292745 | A1* | 9/2019 | Arntz | E02D 7/28 |

FOREIGN PATENT DOCUMENTS

| | | | |
|---|---|---|---|
| EP | 3114283 | A1 | 1/2017 |
| FR | 2418301 | A1 | 9/1979 |
| NL | 2006722 | C2 | 11/2012 |
| WO | 2003085208 | A1 | 10/2003 |
| WO | 2003100178 | A1 | 12/2003 |
| WO | 2013081455 | A1 | 6/2013 |
| WO | 2020207903 | A1 | 10/2020 |

* cited by examiner

Fig. 12
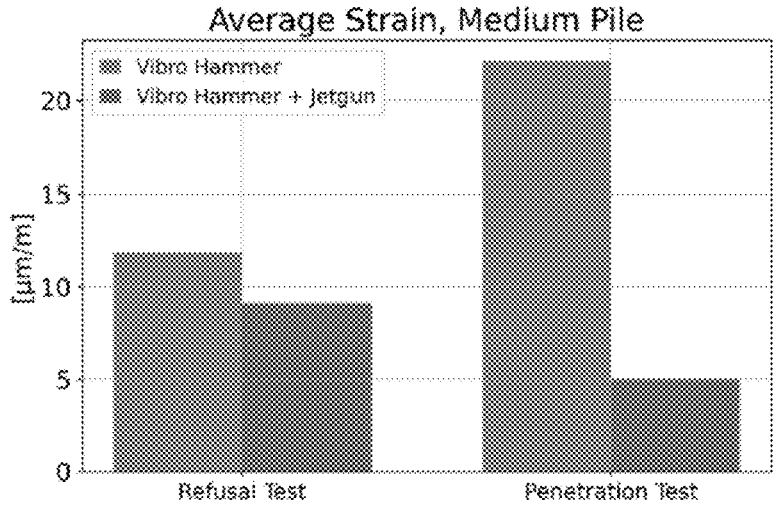
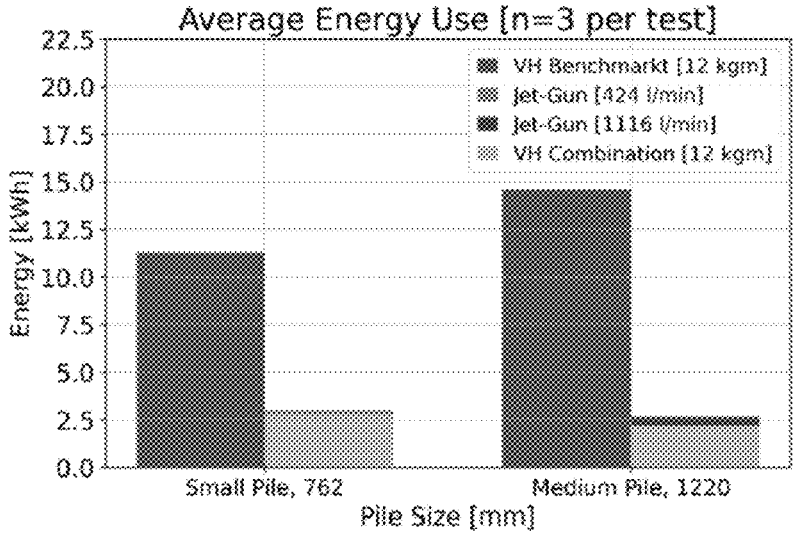
Fig. 13

DETACHABLE FLUIDISATION DEVICE

FIELD OF THE INVENTION

The invention is directed to a detachable fluidisation device for use in a vertical positioned tubular foundation pile comprising of a central element and radially extending fixing means. The radially extending fixing means can have a first position wherein, in use, the central element is radially fixed to the interior of the tubular foundation pile and a second position which allows the fluidisation device to axially move along the length of the tubular foundation pile.

BACKGROUND

Such a device is described in WO2020/207903. A detachable fluidisation device for use in a tubular foundation pile comprising of a central element connected to radially extending and in length variable actuators. The actuators are connected at their radial end with a pressing element provided with a clamp suited to press the clamp to the lower end of the tubular foundation pile. The pressing elements are provided means to discharge a fluid from the lower end of the tubular housing in a direction which has a downward and upward directional component. The device is further provided with means to discharge a fluid into the interior space of the tubular housing of the tubular foundation pile and the pressing element is further provided with rotating eccentric masses as vibration means.

FR2418301 describes a method to bore a pile into soil by a vibrating platform externally fixed to the pile. When the pile reaches a more resistant layer an auger type bore is lowered into the pile. Soil is actively removed from the pile.

WO03/085208 describes a retractable bore head for installing adjoining tubular elements. The tubular elements may be connected to form a so-called deep wall. The bore head is provided with a rotating excavation means which has a larger diameter than the tubular pile. Soil entering the tube may be flushed away using water having a slightly higher pressure than the surrounding water.

NL2006722 describes a bore and vibrating system to drive a hollow pile into the ground. The vibrating system is mounted at the upper end of the pile. The bore drills a hole in the ground at the centre of the hollow pile. The rotary moving bore is drivenfrom the upper end of the pile by means of a drill string extending downwards to the bore.

Vibrohammers are known to drive foundation piles in an underwater bed as described in WO03/100178. In this method a tubular foundation pile of a so-called monopile penetrates the seabed using a vibration arrangement clamped to the upper end of the foundation pile. The vibration arrangement may weigh 40-50 tonnes and may be one as described in U.S. Pat. No. 5,653,556. A disadvantage of a vibrohammer is that too much noise is generated for the sea life and that the metal foundation pile may be damaged in terms of strain by the vibrohammer.

A disadvantage of the prior art devices is that the penetration speed is not sufficiently high, especially when more dense underwater beds are to be penetrated and/or when the diameter of the tubular foundation is larger than for example 1 meter as is the case for foundations used for wind turbines.

The object of the present invention is to provide a detachable fluidisation device for use in a vertical positioned tubular foundation pile which does not have the disadvantages of the prior art designs.

SUMMARY

This object is achieved with the following detachable fluidisation device. Detachable fluidisation device for use in a vertical positioned tubular foundation pile having a pile axis and comprising of a central element and radially extending fixing means, wherein the radially extending fixing means can have a first position wherein, in use, the central element is radially fixed to the interior of the tubular foundation pile and a second position which allows the fluidisation device to axially move along the length of the tubular foundation pile, wherein the central element has at its lower end, when the detachable fluidisation device is in its orientation of use, a rotating lower end which in use can rotate in a direction of rotation along the pile axis and wherein the rotating lower end is provided with horizontally extending arms, which arms are each provided with high pressure water injection nozzles and with mechanical cutting elements extending from the arm in the direction of rotation.

Applicants found that by providing a rotating lower end provided with more than one mechanical cutting elements and high pressure water injection nozzles a jet gun is provided which can be used in combination with a vibrohammer and wherein the strain can be reduced by 70% as compared to when only a vibrohammer is used. This is also a measure for noise reduction.

The invention will be described in more detail below. Horizontal, vertical, upper and lower is used to describe the invention in its normal use but is not intended to limit the invention to only that orientation.

The high pressure water injection nozzles are preferably rotating nozzles. The high pressure water injection nozzles are preferably rotating nozzles. The rotating nozzles are preferably positioned under an angle of between 0 and 90 degrees and more preferably between 30 and 60 degrees with the vertical.

The high pressure water injection nozzles are preferably positioned in a single row along a rotating arm extending from the central element.

Preferably two arms extend from the central element.

Preferably the mechanical cutting elements are teeth positioned at one side of the arm. The teeth are positioned at the side of the arm in the direction of rotation such that they cut the soil as the arm rotates.

The radially extending fixing means may be as described in the earlier referred to WO2020/207903. Preferably these arms are moved from first to second position by means of hydraulics. The fixing means may be provided with wheels to guide the detachable fluidisation device axially and vertically upwards in the tubular foundation pile.

The high pressure water injection nozzles are suitably connected to pumps via high pressure water conduits. These pumps are preferably positioned externally from the foundation pile, for example on a floating vessel. The high pressure conduits may thus have a length of at least the length of the foundation pile and to even twice or three times the length of the foundation pile.

The rotating nozzle preferably comprises of a non-rotating fixed part and a rotating nozzle head as present in a nozzle head chamber wherein the rotating nozzle head has an upper and lower end, wherein the nozzle head chamber has a wall defining the chamber and an opening at its lower end, the opening has sides and the wall of the nozzle head chamber has one or more openings for discharging a water jet into the nozzle head chamber, wherein the lower end of the rotating nozzle head is present in the opening of the nozzle head chamber such that a sleeve opening between rotating nozzle head and the sides of the opening of the nozzle head chamber remains, wherein the non-rotating part is provided with an inlet for pressurised water and a conduit for passage of pressurised water to an inlet for pressurised water as present at the upper end of the rotating nozzle head, said inlet for water being fluidly connected to one or more nozzle outlets as present at the lower end of the rotating nozzle head from which in use a jet is ejected and wherein the rotating nozzle head is further provided with a horizontal water wheel having a vertical axis of rotation at its upper end which is functionally aligned with the one or more openings for discharging a water jet into the nozzle head chamber such that a rotation of the rotating nozzle head results.

The pressurised water for the water jet or jets ejected into the nozzle head chamber and the pressurised water provided to the non-rotating part may suitably be from the same source. Preferably a common or separate manifolds for pressurised water is present in the arms. Conduits fluidly connect this manifold or manifolds with the one or more openings in the wall of the nozzle head chamber and with the inlet for pressurised water in the non-rotating part. The sleeve opening between rotating nozzle head and the sides of the opening of the nozzle head chamber allows the water supplied to the nozzle head chamber to be discharged from the nozzle head chamber. This flow of water prevents that soil can accumulate at the rotating nozzle heads and provides for a water lubrication of the rotating nozzle head within the nozzle head chamber.

The invention is also directed to the above described rotating nozzle, alone or as part of a soil-shifting apparatus and to its use in soil-shifting.

The invention is especially directed to a combination of a vibro-hammer and a detachable fluidisation device according to this invention, wherein the vibrohammer is connected to the detachable fluidisation device by in length variable cables.

The preferred combination further comprising a frame work connected to the vibrohammer and provided with guiding means for high pressure water conduits and a winch for the in length variable cables.

The invention is also directed to the following method for placing a vertically positioned tubular foundation in an underwater bed wherein a combination according to this invention is used, wherein the vibrohammer is positioned at the upper end of the tubular foundation and the a detachable fluidisation device is lowered to the lower end of the foundation at which lower end the detachable fluidisation device is radially fixed to the internal walls of the tubular foundation, wherein the vibrohammer vibrates the tubular foundation and wherein pressurised water is supplied to the detachable fluidisation device, the rotating lower end to rotate and eject water jets from the water injection nozzle and causing the soil of the underwater bed to be cut by the mechanical cutting elements. The rotating lower end is rotated by hydraulic motors or electrical motors.

Preferably the pressure of the water as supplied to the water injection nozzles is at least 5 bar, and preferably between 20 and 500 bar.

Preferably the rotating lower end rotates at between 1 and 120 rotations per 30 minute (rpm) and preferably between 5 and 60 rpm.

The method is especially suited to for placing tubular foundations having an internal diameter of between 1 and 20 m.

The method is suited to be used wherein the underwater bed comprises a layer of sand, silt, soft clay, very stiff clay or Boom clay or any combination of aforementioned.

BRIEF DESCRIPTION OF THE DRAWING FIGURES

Many aspects of the present disclosure can be better understood with reference to the following drawings. The components in the drawings are not necessarily to scale with emphasis instead being placed upon clearly illustrating the principles of the disclosure. Moreover, in the drawings, like reference numerals designate corresponding parts throughout the several views.

FIG. 12 shows experimental average strain.

FIG. 13 shows experimental average energy use.

DETAILED DESCRIPTION OF EXAMPLE EMBODIMENTS

The invention will be illustrated by the following Figures.

Figure 1:
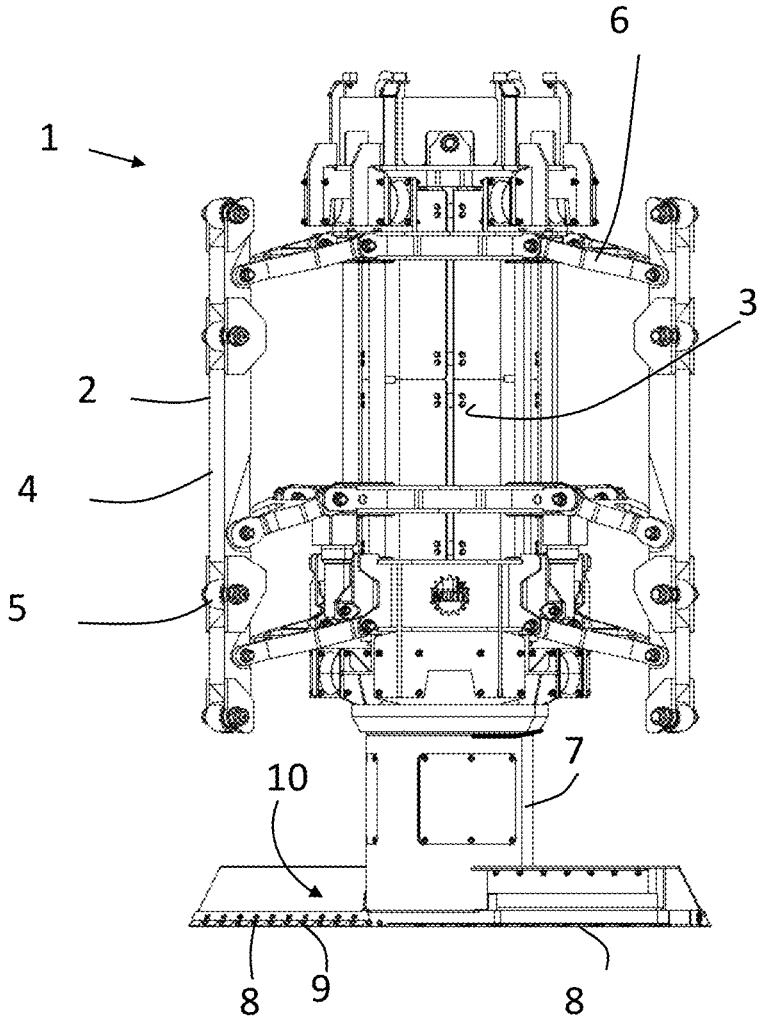
FIG. 1 shows a detachable fluidisation device according this invention.

FIG. 1 shows a detachable fluidisation device (1) according to this invention. Radially extending fixing means (2) are connected to a central element (3). The fixing means are beams (4) provided with wheels (5) which are connected to the central element (3) by arms (6). Shown is a first position wherein, in use, the central element (3) is radially fixed to the interior of the tubular foundation pile. The central element (3) has a rotating lower end (7) which can rotate along a centre axis (7*a*). The rotating lower end part (7) is provided with two arms (8). On each arm (8) cutting teeth (9) are present extending from the arm (8) in the direction (10) of rotation.

Figure 2:
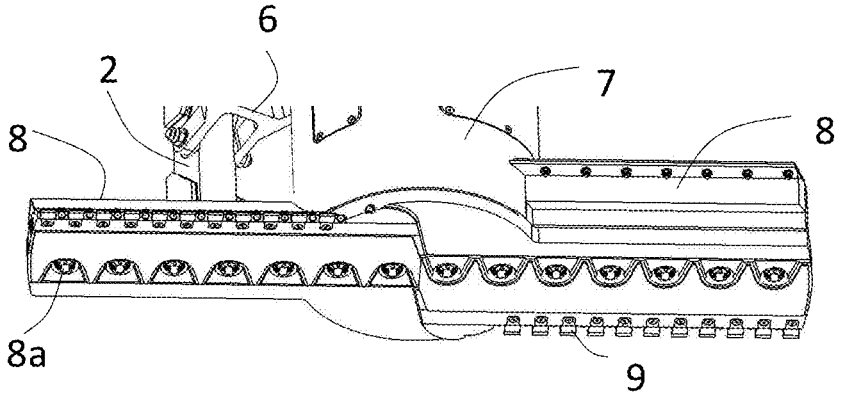
FIG. 2 shows the arms of FIG. 1 in more detail from below.

FIG. 2 shows arms (8) of FIG. 1 in more detail as seen under an angle from below. Seven rotating high pressure water injection nozzles (8*a*) per arm (8) are shown positioned in a row. Further the lower end part (7) is shown as well as the lower end of a beam (4) and part of an arm (6) connected to said beam (4).

Figure 3:
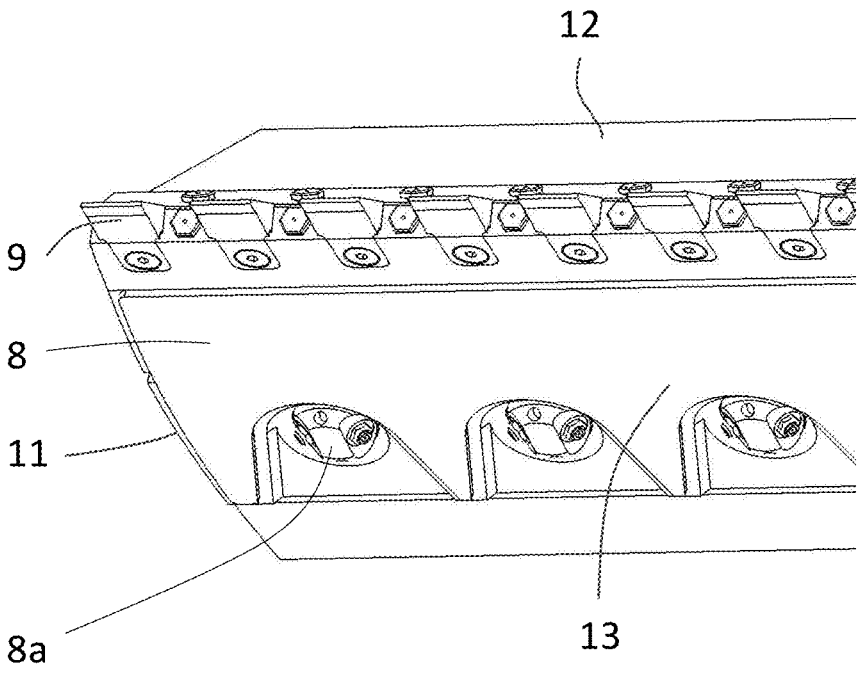
FIG. 3 shows the radially extending end of an arm of FIG. 2.

FIG. 3 shows the radially extending end (11) of one of the arms (8) of FIG. 2 showing three of the seven rotating high pressure water injection nozzles (8*a*) in a single row along the arm (8) as seen under an angle from below. A top cover plate (12) and a bottom plate (13) define an internal space (14) of the arm (8).

Figure 4:
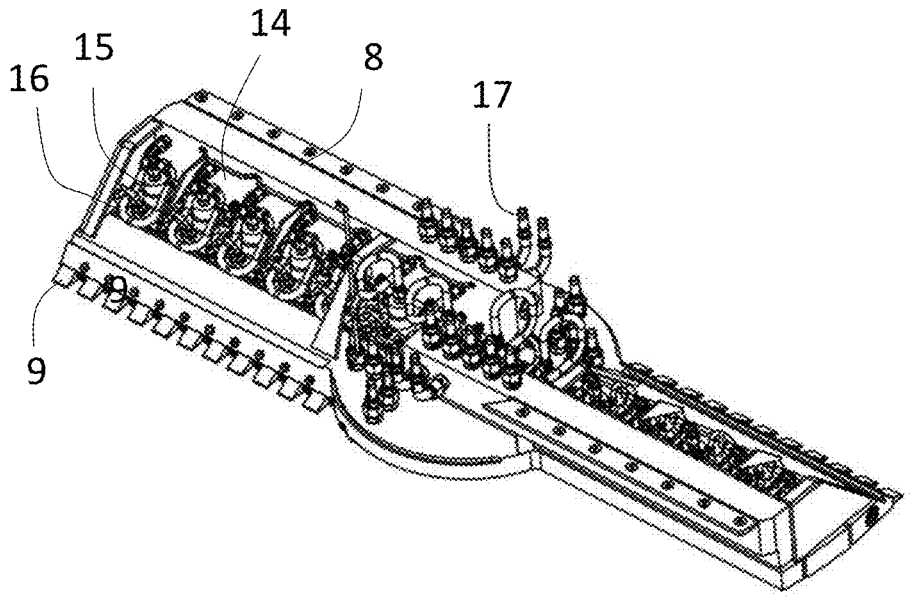
FIG. 4 shows the two arms with the cover plate.

FIG. 4 shows the two arms (8) without the cover plate (12) allowing a view of the internal space (14) of the arms (8) under an angle from above. A non-rotating fixed part (15) per nozzle (8*a*) is seen as well as various conduits (16) for supply of pressurised water to the various nozzles (8*a*). The conduits (16) are fluidly connected to supply conduits (17) which extend upwards in the rotating lower end (7) of the central element (3).

Figure 5:
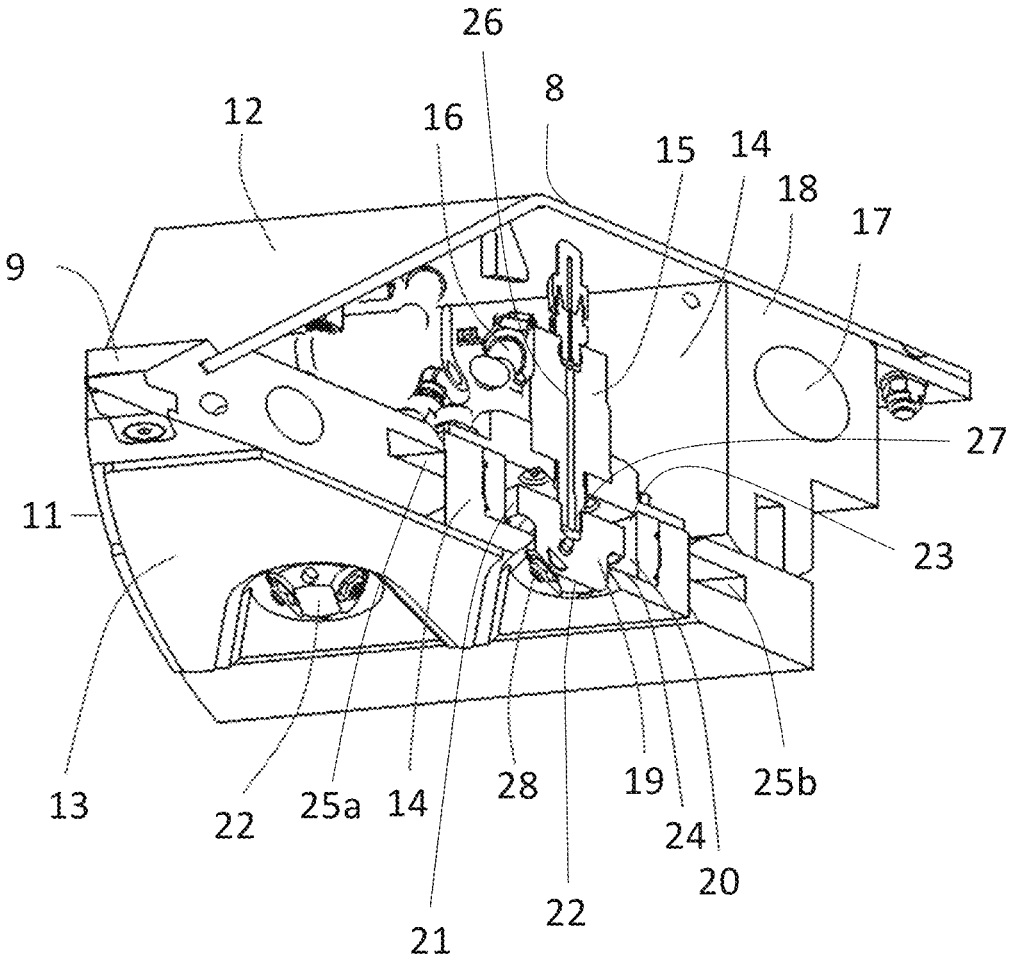
FIG. 5 is a three dimensional cross-sectional view of a nozzle shown in FIG. 3.

FIG. 5 is a three dimensional cross-sectional view at the second nozzle (8*a*) of FIG. 3. This view shows the internal space (14) of the arm (8). A structural element (18) extending from the centre axis (7*a*) to the radially extending end (11) is provided with a channel (18) for supply of pressurised water to conduits (16). This channel (17) fluidly connects the supply conduits (16) of FIG. 4 and the individual rotating high pressure water injection nozzles (8*a*). The rotating nozzle (8*a*) comprises of a non-rotating fixed part (15) and a rotating nozzle head (19) as present in a nozzle head chamber (20). The non-rotating fixed part (15) is fixed to the arm (8) in the internal space (14). The rotating nozzle head (19) has an upper (21) and lower (22) end. The nozzle head chamber (20) has a wall (23) defining the chamber (20) and an opening (24) at its lower end. Two manifold channels (25*a*,25*b*) for pressurised water are shown. From these channels water is injected into the nozzle head chamber (20) as will be illustrated in FIGS. 6 and 7. To the non-rotating fixed part (15) pressurised water is supplied via conduit (16). The water flows downwards via an axial channel (26), as the conduit for passage of pressurised water, to a pin (27) provided with an outlet fluidly connected to the upper end (21) of the rotating nozzle head (19). The pin (27) is positioned in a pin opening as present in the upper end (21) of the rotating nozzle head (19) such that the rotating nozzle head (19) can rotate around said pin (27).

The non-rotating part is provided with an inlet (not shown) for pressurised water and fluidly connected to an inlet for pressurised water as present at the upper end of the rotating nozzle head. Said inlet for water being fluidly connected to two nozzle outlets (28) as present at the lower end (22) of the rotating nozzle head (19) from which in use a jet is ejected.

The rotating nozzle head (19) is further contained within the chamber (20) because the upper end (21) of the rotating nozzle head (19) has a larger diameter than the opening (24). The lower end (22) of the rotating nozzle head (19) is present in the opening of the nozzle head chamber such that a sleeve opening between rotating nozzle head and the sides of the opening (24) of the nozzle head chamber (20) remains. Via this sleeve opening water can flow out of the nozzle head chamber (20). The two nozzle outlets (28) for discharging a water jet make an angle of 45 degrees with the vertical such that in use the water jet is discharged making an angle of 45 degrees with the vertical. Preferably this angle is between 30 and 60 degrees.

Figure 6:
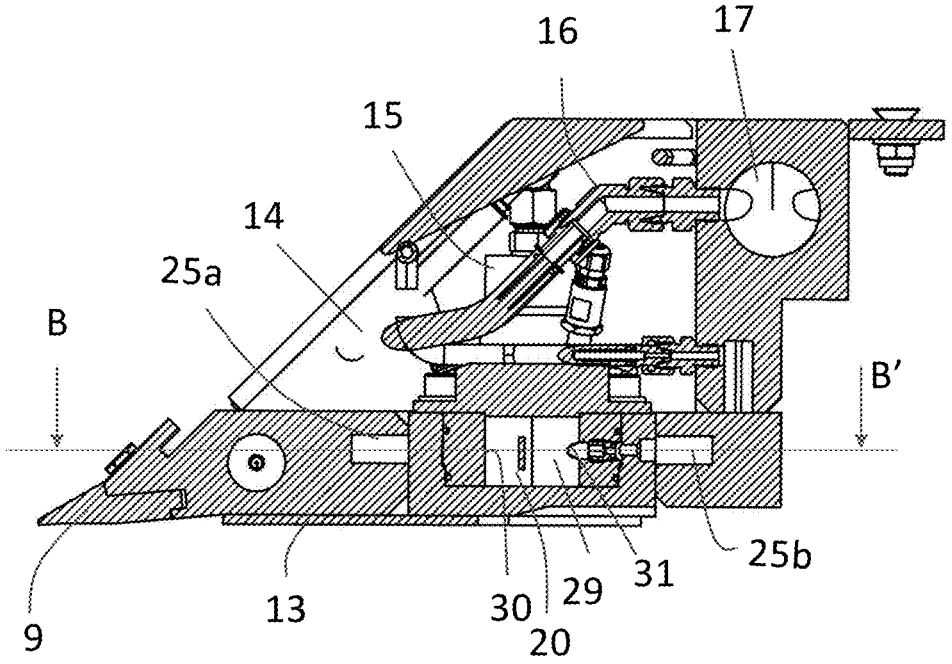
FIG. 6 shows a cross-sectional view of a nozzle.
Figure 7:
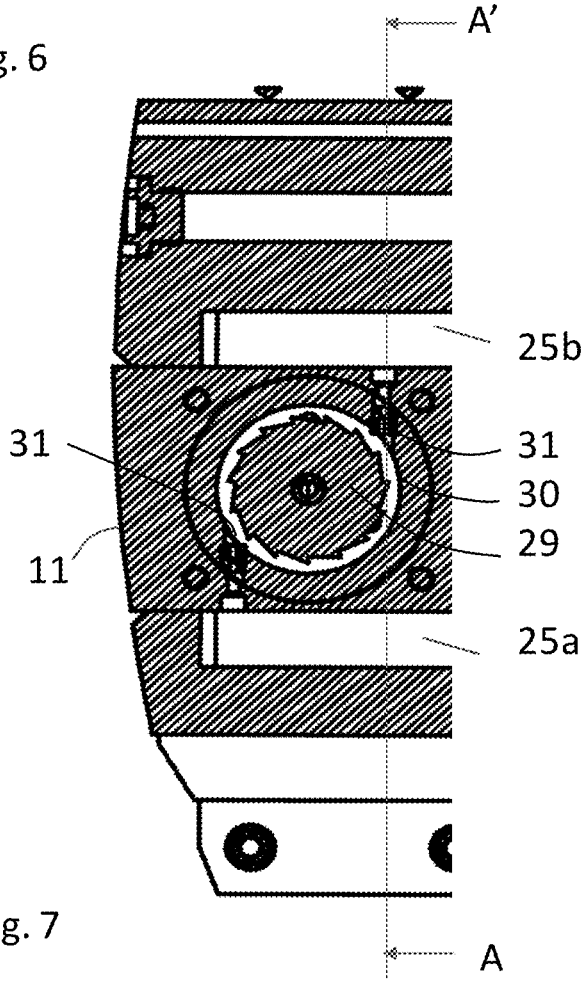
FIG. 7 shows a horizontal cross-section BB of FIG. 6.

FIG. 6 shows a cross-sectional view of the first nozzle (8*a*) when counting from the radially extending end (11) of arm (8) from aside. The cross section is made at AA' as indicated in FIG. 7. The internal of the nozzle head chamber (20) is shown in which a horizontal water wheel (29) having a vertical axis of rotation as part of the rotating nozzle head (19) is present. The wall (30) of the nozzle head chamber (20) has two openings (31) for discharging a water jet into the nozzle head chamber (20). The direction of these water jets is tangential with the water wheel (29) as shown in FIG. 7. The water as supplied to these two openings (31) is supplied from manifold channels (25*a*,25*b*).

FIG. 7 shows a horizontal cross-section BB' as shown in FIG. 6. The horizontal water wheel (29) is shown as positioned in the nozzle head chamber (20) and the two openings (31) from which a water jet is ejected in use in a tangential direction vis-à-vis the water wheel (29). In this manner the water wheel (29) is functionally aligned with the one or more openings for discharging a water jet into the nozzle head chamber such that a rotation of the rotating nozzle head (19) results.

Figure 8:
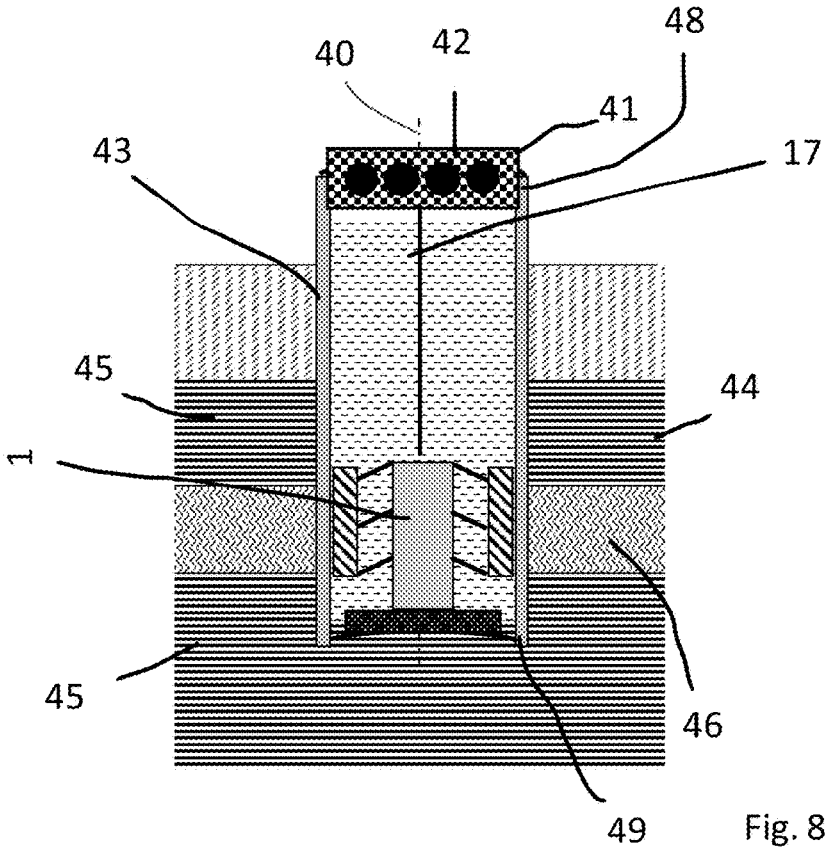
FIG. 8 shows a combination of a vibro-hammer and the device of FIG. 1 as positioned on and in a foundation pile.

FIG. 8 shows a combination (41) of a vibro-hammer (42) and the detachable fluidisation device (1) of FIG. 1 as positioned on and in a foundation pile (43) having a pile axis (40) which is placed in an underwater bed (44) which has sand layers (45) and clay layer (46). The vibrohammer (42) is connected to the detachable fluidisation device (1) by in length variable cables (47). The vibrohammer (42) is positioned at the upper end (48) of the tubular foundation (43) and the a detachable fluidisation device (1) is lowered to the lower end (49) of the foundation (43). At which lower end (49) the detachable fluidisation device (1) is radially fixed to the internal walls of the tubular foundation (43). The vibrohammer vibrates the tubular foundation (43). Pressurised water is supplied to the detachable fluidisation device (1) causing the rotating lower end (7) to rotate and eject water jets from the water injection nozzles (8*a*) and causing the soil (45) of the underwater bed to be cut by the mechanical cutting teeth (9).

Figure 9:
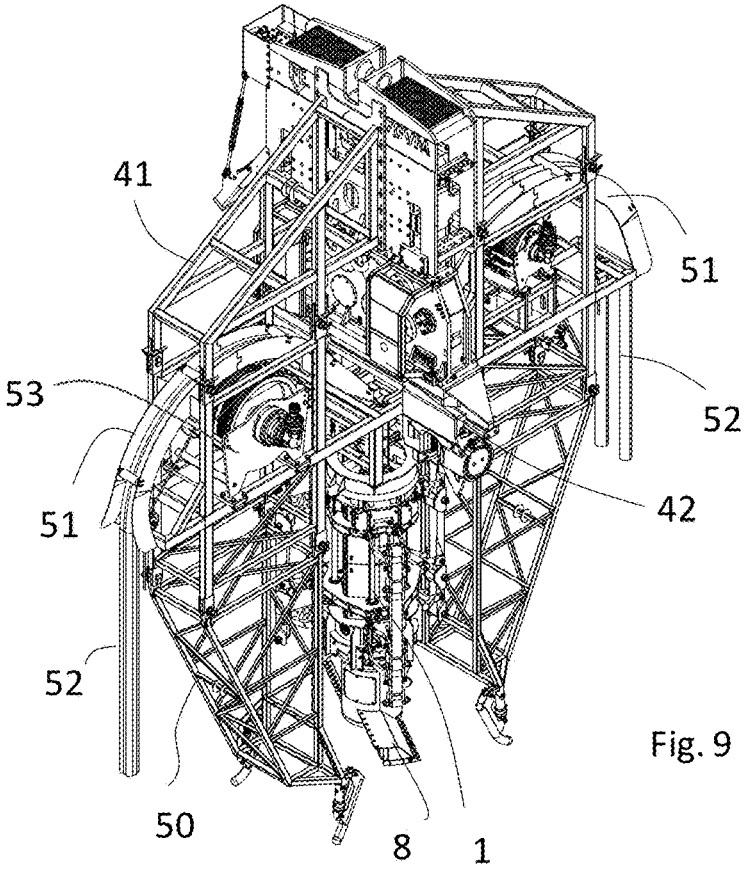
FIG. 9 shows the combination of a vibro-hammer and the device of FIG. 1 in more detail.

FIG. 9 shows the combination (41) in more detail without the foundation pile. The combination (41) has a frame work (50) connected to the vibrohammer (42) and provided with guiding means (51) for high pressure water conduits (52) and with a winch (53) for the in length variable cables (47).

Figures 10, 11:
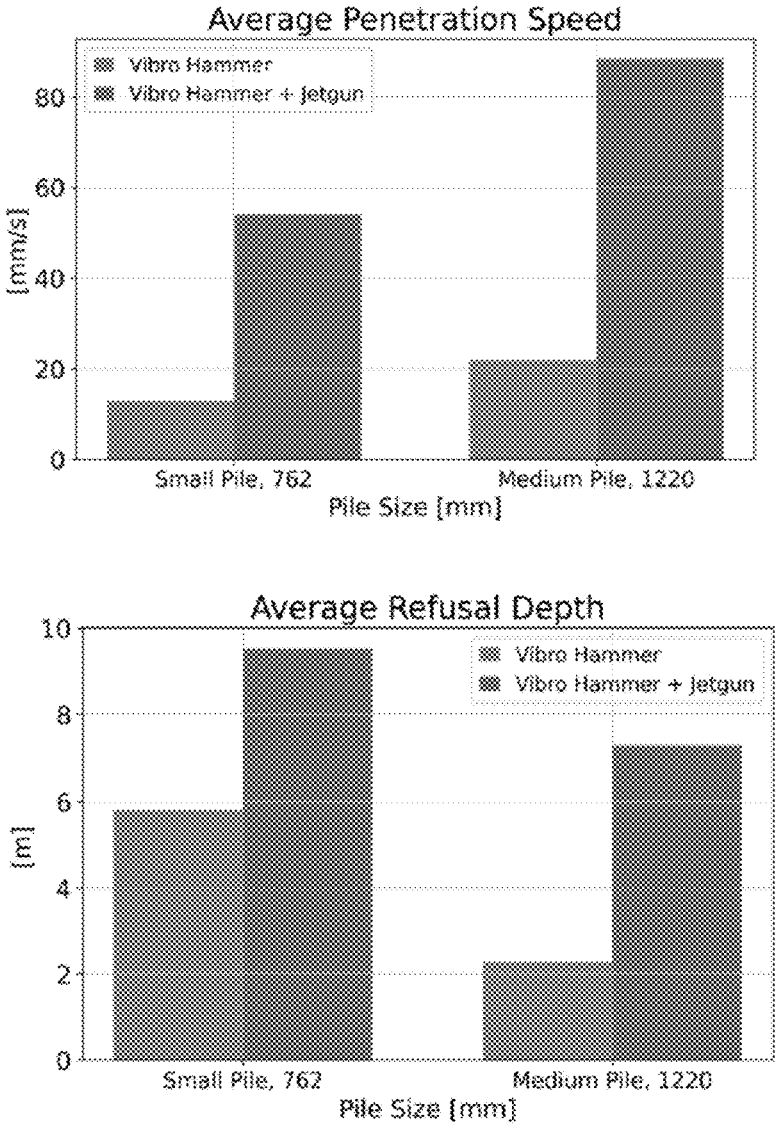
FIG. 10 shows experimental average penetration speed.
FIG. 11 shows experimental refusal depth

The invention has been tested for a 2 m internal diameter foundation pile as shown in FIG. 3. It was found that the average penetration speed (FIG. 10) and average refusal depth (FIG. 11) is increased substantially and average strain is reduced (FIG. 12) and less energy is required (FIG. 13) when the combination is used as compared to only use of only a vibrohammer.

The invention claimed is:

1. A detachable fluidisation device for use in a vertical positioned tubular foundation pile having a pile axis and comprising a central element and radially extending fixing means;

wherein the radially extending fixing means can have a first position wherein, in use, the central element is radially fixed to the interior of the tubular foundation pile and a second position which allows the fluidisation device to axially move along the length of the tubular foundation pile;

wherein the central element has at its lower end, when the detachable fluidisation device is in its orientation of use, a rotating lower end which in use can rotate in a direction of rotation along the pile axis;

wherein the rotating lower end is provided with horizontally extending arms, which arms are each provided with high pressure water injection nozzles and with mechanical cutting elements extending from the arm in the direction of rotation;

wherein the high pressure water injection nozzles are rotating nozzles; and wherein the rotating nozzle comprises a non-rotating fixed part and a rotating nozzle head as present in a nozzle head chamber, wherein the rotating nozzle head has an upper and lower end, wherein the nozzle head chamber has a wall defining the chamber and an opening at its lower end, the opening has sides, and the wall of the nozzle head chamber has one or more openings for discharging a water jet into the nozzle head chamber, wherein the lower end of the rotating nozzle head is present in the opening of the nozzle head chamber such that a sleeve opening between rotating nozzle head and the sides of the opening of the nozzle head chamber remains, wherein the non-rotating part is provided with an inlet for pressurised water and a conduit for passage of pressurised water to an inlet for pressurised water as present at the upper end of the rotating nozzle head, said inlet for water being fluidly connected to one or more nozzle outlets as present at the lower end of the rotating nozzle head from which in use a jet is ejected, and wherein the rotating nozzle head is further provided with a horizontal water wheel having a vertical axis of rotation at its upper end which is functionally aligned with the one or more openings for discharging a water jet into the nozzle head chamber such that a rotation of the rotating nozzle head results.

2. The detachable fluidisation device according to claim 1, wherein the nozzles are positioned under an angle of between 30 and 60 degrees with the vertical.

3. The detachable fluidisation device according to claim 1, wherein the high pressure water injection nozzles are positioned in a single row along the arm extending from the central element.

4. The detachable fluidisation device according to claim 1, wherein the rotating lower end is provided with two arms.

5. The detachable fluidisation device according to claim 1, wherein the mechanical cutting elements are teeth positioned at one side of the arm in the direction of rotation.

6. The detachable fluidisation device according to claim 5, wherein the radially extending fixing means are moved from first to second position by means of hydraulics.

7. The detachable fluidisation device according to claim 1, wherein the high pressure water injection nozzles are connected to pumps via high pressure water conduits.

8. A kit of parts comprising of a vibro-hammer and a detachable fluidisation device according to claim 1.

9. A combination of a vibro-hammer and a detachable fluidisation device according to claim 1, wherein the vibro-hammer is connected to the detachable fluidisation device by in length variable cables.

10. The combination according to claim 9, further comprising a frame work connected to the vibro-hammer and provided with guiding means for high pressure water conduits and with a winch for the in length variable cables.

11. A method of placing a tubular foundation in an underwater bed wherein a combination according to claim 10 is used and wherein the vibro-hammer is positioned at the upper end of the tubular foundation and the a detachable fluidisation device is lowered to the lower end of the foundation at which lower end the detachable fluidisation device is radially fixed to the internal walls of the tubular foundation and wherein the vibro-hammer vibrates the tubular foundation and wherein pressurised water is supplied to the detachable fluidisation device causing the rotating lower end to rotate and eject water jets from the water injection nozzle and causing the soil of the underwater bed to be cut by the mechanical cutting elements.

12. The method of claim 11, wherein the pressure of the water as supplied to the water injection nozzles is at least 5 bar, and preferably between 20 and 500 bar.

13. The method of claim 11, wherein the rotating lower end rotates at between 1 and 120 rotations per minute and preferably between 5 and 60 rpm.

14. The method of claim 11, wherein the internal diameter of the tubular foundation is between 1 and 20 m.

15. The method of claim 11, wherein the underwater bed comprises a layer of sand, silt, soft clay, very stiff clay or Boom clay or any combination of aforementioned.

16. A rotating nozzle comprising of a non-rotating fixed part and a rotating nozzle head as present in a nozzle head chamber:

wherein the rotating nozzle head has an upper and lower end, wherein the nozzle head chamber has a wall defining the chamber and an opening at its lower end, the opening has sides, and the wall of the nozzle head chamber has one or more openings for discharging a water jet into the nozzle head chamber, wherein the lower end of the rotating nozzle head is present in the opening of the nozzle head chamber such that a sleeve opening between rotating nozzle head and the sides of the opening of the nozzle head chamber remains, wherein the non-rotating part is provided with an inlet for pressurised water and a conduit for passage of pressurised water to an inlet for pressurised water as present at the upper end of the rotating nozzle head, said inlet for water being fluidly connected to one or more nozzle outlets as present at the lower end of the rotating nozzle head from which in use a jet is ejected, and wherein the rotating nozzle head is further provided with a horizontal water wheel having a vertical axis of rotation at its upper end which is functionally aligned with the one or more openings for discharging a water jet into the nozzle head chamber such that a rotation of the rotating nozzle head results.

17. Use of the rotating nozzle of claim 16 in soil-shifting.

* * * * *